US009761214B2

(12) United States Patent
Dickins et al.

(10) Patent No.: US 9,761,214 B2
(45) **Date of Patent: *Sep. 12, 2017**

(54) SYSTEM AND METHOD FOR WIND DETECTION AND SUPPRESSION

(71) Applicants: Dolby Laboratories Licensing Corporation, San Francisco, CA (US); Dolby International AB, Amsterdam Zuidoost (NL)

(72) Inventors: Glenn N Dickins, Como (AU); Leif Jonas Samuelsson, Sundbyberg (SE)

(73) Assignees: Dolby Laboratories Licensing Corporation, San Francisco, CA (US); Dolby International AB, Amsterdam Zuidoost (NL)

( * ) Notice: Subject to any disclaimer, the term of this patent is extended or adjusted under 35 U.S.C. 154(b) by 0 days.

This patent is subject to a terminal disclaimer.

(21) Appl. No.: 15/056,977

(22) Filed: Feb. 29, 2016

(65) Prior Publication Data

US 2016/0180826 A1 Jun. 23, 2016

Related U.S. Application Data

(63) Continuation of application No. 13/983,920, filed as application No. PCT/US2012/022648 on Jan. 26, 2012, now Pat. No. 9,313,597.

(Continued)

(51) Int. Cl.

| | |
|---|---|
| ***H04R 3/00*** | (2006.01) |
| ***H04R 29/00*** | (2006.01) |
| ***G10K 11/00*** | (2006.01) |

(52) U.S. Cl.

CPC ..... *G10K 11/002* (2013.01); *H04R 3/005* (2013.01); *H04R 29/004* (2013.01);

(Continued)

(58) Field of Classification Search

CPC ..... G10K 11/002; G10K 2210/3018; G10K 2210/3025; G10K 2210/3208; H04R 29/004; H03R 2410/07

See application file for complete search history.

(56) References Cited

U.S. PATENT DOCUMENTS

| | | | |
|---|---|---|---|
| 5,946,400 | A | 8/1999 | Matsuo |
| 6,647,367 | B2 | 11/2003 | McArthur |

(Continued)

FOREIGN PATENT DOCUMENTS

| | | |
|---|---|---|
| DE | 3808038 | 9/1989 |
| EP | 2 115 565 | 11/2009 |

(Continued)

OTHER PUBLICATIONS

Cerwin S. et al, "The VLAA; A Very Large Acoustic Array," Proceedings of the APIE, May 2005.

(Continued)

*Primary Examiner* — Sonia Gay

(74) *Attorney, Agent, or Firm* — Geoffrey T. Staniford; Staniford Tomita LLP

(57) ABSTRACT

In one embodiment, a pickup system includes a wind detector and a wind suppressor. The wind detector has a plurality of analyzers each configured to analyze first and second input signals, and a combiner configured to combine outputs of the plurality of analyzers and issue, based on the combined outputs, a wind level indication signal indicative of wind activity. The analyzers can be selected from a group of analyzers including a spectral slope analyzer, a ratio analyzer, a coherence analyzer, a phase variance analyzer and the like. The wind suppressor has a ratio calculator configured to generate a ratio of the first and second input signals, and a mixer configured to select one of the first or second input signals and to apply to the selected input signal (Continued)

one of first or second panning coefficients based on the wind level indication signal and on the ratio.

6 Claims, 14 Drawing Sheets

Related U.S. Application Data

(60) Provisional application No. 61/441,551, filed on Feb. 10, 2011.

(52) U.S. Cl.
CPC ... *H04R 29/008* (2013.01); *G10K 2210/3018* (2013.01); *G10K 2210/3025* (2013.01); *G10K 2210/3028* (2013.01); *H04R 2410/07* (2013.01)

(56) References Cited

U.S. PATENT DOCUMENTS

| | | | | |
|---|---|---|---|---|
| 7,171,008 | B2 | 1/2007 | Elko | |
| 7,206,421 | B1 | 4/2007 | Taenzer | |
| 7,340,068 | B2 | 3/2008 | Petersen | |
| 7,725,315 | B2 | 5/2010 | Hetherington | |
| 8,781,137 | B1 * | 7/2014 | Goodwin | H04R 3/005 381/94.1 |
| 2004/0165736 | A1 * | 8/2004 | Hetherington | G10L 21/0208 381/94.3 |
| 2004/0185804 | A1 | 9/2004 | Kanamori | |
| 2006/0120540 | A1 | 6/2006 | Luo | |
| 2006/0233391 | A1 | 10/2006 | Park | |
| 2007/0030989 | A1 | 2/2007 | Kates | |
| 2007/0219784 | A1 * | 9/2007 | Zhang | H04R 25/505 704/200.1 |
| 2008/0226098 | A1 | 9/2008 | Haulick et al. | |
| 2008/0247555 | A1 | 10/2008 | Avendano | |
| 2009/0112584 | A1 | 4/2009 | Li | |
| 2009/0175466 | A1 | 7/2009 | Elko | |
| 2009/0216526 | A1 | 8/2009 | Schmidt | |
| 2009/0238369 | A1 | 9/2009 | Ramakrishnan et al. | |
| 2010/0061568 | A1 | 3/2010 | Rasmussen | |
| 2010/0062713 | A1 | 3/2010 | Blamey | |
| 2010/0082339 | A1 | 4/2010 | Konchitsky | |
| 2010/0208902 | A1 * | 8/2010 | Yoshizawa | G10L 21/0208 381/56 |
| 2010/0254541 | A1 | 10/2010 | Hayakawa | |
| 2011/0221864 | A1 | 9/2011 | Filippini | |
| 2012/0123771 | A1 | 5/2012 | Chen et al. | |
| 2012/0163622 | A1 | 6/2012 | Karthik et al. | |
| 2012/0207325 | A1 | 8/2012 | Taenzer | |
| 2013/0163781 | A1 | 6/2013 | Thyssen et al. | |

FOREIGN PATENT DOCUMENTS

| | | |
|---|---|---|
| GB | 2434051 | 10/2007 |
| GB | 2447320 | 9/2008 |
| GB | 2453118 | 4/2009 |
| JP | HO3-139097 | 6/1991 |
| JP | 05-328480 | 12/1993 |
| JP | 2001-124621 | 5/2001 |
| JP | 2002-503924 | 2/2002 |
| JP | 2004-187283 | 2/2004 |
| JP | 2004-254329 | 9/2004 |
| JP | 2008-263483 | 10/2008 |
| JP | 2008-263498 | 10/2008 |
| JP | 2009-503568 | 1/2009 |
| JP | 2010-028307 | 2/2010 |
| JP | 2011-030022 | 2/2011 |
| WO | 2007/133321 | 11/2007 |
| WO | 2008/079327 | 7/2008 |
| WO | 2009/042385 | 4/2009 |
| WO | 2009/117474 | 9/2009 |
| WO | 2010/002676 | 1/2010 |
| WO | 2010/063660 | 6/2010 |
| WO | 2011/006496 | 1/2011 |
| WO | 2012/107561 | 8/2012 |
| WO | 2012/109384 | 8/2012 |
| WO | 2012/109385 | 8/2012 |

OTHER PUBLICATIONS

Choi, S. et al, "A New Microphone System for Near Whispering," Journal of Acoustical Society of America, vol. 114, Issue 2, pp. 801-812, Aug. 2003.

Elko, G. et al, "Electronic Pop Protection for Microphones," IEEE Workshop on Applications of Signal Processing to Audio and Acoustics, Oct. 2007.

Schmitt, A., "Directivity and Speech Intelligibility Characteristics of a Logarithmically-Spaced Microphone Array in a Temperature- and Wind-Stratified Atmosphere," University of Texas, Jan. 1, 1968.

Wahab, A. et al, "Intelligent Dashboard with Speech Enhancement," Proceedings of International Conference on Information, Communications and Signal, Sep. 9-12, 1997.

Van Tress, H. et al, "Optimum Array Processing: Decision Estimation and Modulation Theory Part IV" May 10, 2002, New York.

Johnson, D. et al, "Array Signal Processing: Concepts and Techniques," Feb. 11, 1993, Edition 1, published by Prentice Hall.

* cited by examiner

SYSTEM AND METHOD FOR WIND DETECTION AND SUPPRESSION

CROSS-REFERENCE TO RELATED APPLICATIONS

This application is a Continuation of U.S. application Ser. No. 13/983,920 filed Aug. 6, 2013, which is a 371 National Phase filing of PCT/US2012/022648 filed Jan. 26, 2012, which claims the benefit of U.S. Provisional Application 61/441,551 filed Feb. 10, 2011.

TECHNICAL FIELD

The present disclosure relates generally to sound pickup systems, and more particularly, to wind detection and abatement for such systems.

BACKGROUND

Wind noise is a problem for pickup systems. Even at levels that may be inaudible to a user of the pickup device, the effect of airflow past the microphone can severely interfere with operation of the device, for example partially or completely obscuring the desired voice of a speaker. Various mechanical and electronic attempts have been made to mitigate the effect of such air flow, including for example baffles or "socks" or other fuzzy material placed over the microphone to break up the turbulence or otherwise shield the microphone. Electronically, various characteristics of wind noise, including for example correlation features at multiple pickups, have been exploited to manipulate the signals derived from the wind-corrupted pickups and compensate or otherwise reduce the effects of the wind noise.

Overview

As described herein, a wind detector includes first and second inputs for receiving first and second input signals in respective first and second channels, a plurality of analyzers each configured to analyze the first and second input signals, the plurality of analyzers being selected from a group of analyzers including a spectral slope analyzer, a ratio analyzer, a coherence analyzer and a phase variance analyzer, and a combiner configured to combine outputs of the plurality of analyzers and issue, based on the combined outputs, a wind level indication signal indicative of wind activity.

Also as described herein, a wind suppressor includes first and second inputs operable to receive first and second input signals in respective first and second channels, a ratio calculator configured to determine a ratio of the first and second input signals, and a mixer configured to select one of the first or second input signals and to apply to said selected input signal one of first or second panning coefficients based on a wind level indication signal and on the ratio, the other of the first or second input signals being unselected.

Also as described herein, a pickup system includes a wind detector and a wind suppressor. The wind detector is configured to receive first and second input signals a plurality of analyzers each configured to analyze the first and second input signals, and a combiner configured to combine outputs of the plurality of analyzers and issue, based on the combined outputs, a wind level indication signal indicative of wind activity. The wind suppressor includes a ratio calculator configured to generate a ratio of the first and second input signals, and a mixer configured to select one of the first or second input signals and to apply to said selected input signal one of first or second panning coefficients based on the wind level indication signal and on the ratio, the other of the first or second input signals being unselected.

Also as described herein, a wind detection method includes receiving first and second input signals, performing a plurality of analyses on the first and second input signals, said plurality of analyses being selected from spectral slope analysis, ratio analysis, coherence analysis and phase variance analysis, and combining results of said plurality of analysis to generate a wind level indication signal.

Also as described herein, a wind suppression method includes receiving first and second input signals, determining a ratio of the first and second input signals, receiving a wind level indication signal, and selecting one of the first or second input signals to apply thereto one of first or second panning coefficients based on the wind level indication signal and on the ratio, the other of the first or second input signals being unselected.

Also as described herein, a method for detecting and suppressing wind includes receiving first and second input signals, performing a plurality of analyses on the first and second input signals, said plurality of analyses being selected from spectral slope analysis, ratio analysis, coherence analysis and phase variance analysis, combining results of said plurality of analysis to generate a wind level indication signal, determining a ratio of the first and second input signals, and selecting one of the first or second input signals to apply thereto one of first or second panning coefficients based on the wind level indication signal and on the ratio, the other of the first or second input signals being unselected.

Also as described herein, a pickup system includes a wind detector configured to receive first and second input signals. The wind detector includes a plurality of analyzers each configured to analyze the first and second input signal, and a combiner configured to combine outputs of the plurality of analyzers and issue, based on the combined outputs, a wind level indication signal indicative of wind activity. The pickup system also includes a filter configured to receive the first and second input signals, the filter having continuously adjustable parameters, including one or more of cutoff and attenuation, the continuously adjustable parameters being adjustable as a function of the wind level indication signal.

Also as described herein, a wind detector includes means for receiving first and second input signals, means for performing a plurality of analyses on the first and second input signals, the plurality of analyses being selected from spectral slope analysis, ratio analysis, coherence analysis and phase variance analysis, and means for combining results of said plurality of analysis to generate a wind level indication signal.

Also as described herein, a wind suppressor includes means for receiving first and second input signals, means for determining a ratio of the first and second input signals, means for receiving a wind level indication signal, and means for selecting one of the first or second input signals to apply thereto one of first or second panning coefficients based on the wind level indication signal and on the ratio, the other of the first or second input signals being unselected.

Also as described herein, a device includes means for receiving first and second input signals, means for performing a plurality of analyses on the first and second input signals, the plurality of analyses being selected from spectral slope analysis, ratio analysis, coherence analysis and phase variance analysis, means for combining results of said plurality of analysis to generate a wind level indication signal, means for determining a ratio of the first and second input signals, and means for selecting one of the first or second input signals to apply thereto one of first or second panning coefficients based on the wind level indication signal and on the ratio, the other of the first or second input signals being unselected.

Also described herein is a program storage device readable by a machine, embodying a program of instructions executable by the machine to perform a method for wind detection. The method includes receiving first and second input signals, performing a plurality of analyses on the first and second input signals, said plurality of analyses being selected from spectral slope analysis, ratio analysis, coherence analysis and phase variance analysis, and combining results of said plurality of analysis to generate a wind level indication signal.

Also described herein is a program storage device readable by a machine, embodying a program of instructions executable by the machine to perform a method for wind detection. The method includes receiving first and second input signals, determining a ratio of the first and second input signals, receiving a wind level indication signal, and selecting one of the first or second input signals to apply thereto one of first or second panning coefficients based on the wind level indication signal and on the ratio, the other of the first or second input signals being unselected.

BRIEF DESCRIPTION OF THE DRAWINGS

The accompanying drawings, which are incorporated into and constitute a part of this specification, illustrate one or more examples of embodiments and, together with the description of example embodiments, serve to explain the principles and implementations of the embodiments.

In the drawings.

DESCRIPTION OF EXAMPLE EMBODIMENTS

Example embodiments are described herein in the context of circuits and processors. Those of ordinary skill in the art will realize that the following description is illustrative only and is not intended to be in any way limiting. Other embodiments will readily suggest themselves to such skilled persons having the benefit of this disclosure. Reference will now be made in detail to implementations of the example embodiments as illustrated in the accompanying drawings. The same reference indicators will be used to the extent possible throughout the drawings and the following description to refer to the same or like items.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

In accordance with this disclosure, the components, process steps, and/or data structures described herein may be implemented using various types of operating systems, computing platforms, computer programs, and/or general purpose machines. In addition, those of ordinary skill in the art will recognize that devices of a less general purpose nature, such as hardwired devices, field programmable gate arrays (FPGAs), application specific integrated circuits (ASICs), or the like, may also be used without departing from the scope and spirit of the inventive concepts disclosed herein. Where a method comprising a series of process steps is implemented by a computer or a machine and those process steps can be stored as a series of instructions readable by the machine, they may be stored on a tangible or non-transitory medium such as a computer memory device (e.g., ROM (Read Only Memory), PROM (Programmable Read Only Memory), EEPROM (Electrically Erasable Programmable Read Only Memory), FLASH Memory, Jump Drive, and the like), magnetic storage medium (e.g., tape, magnetic disk drive, and the like), optical storage medium (e.g., CD-ROM, DVD-ROM, paper card, paper tape and the like) and other types of program memory.

The term "exemplary" is used exclusively herein to mean "serving as an example, instance or illustration." Any embodiment described herein as "exemplary" is not necessarily to be construed as preferred or advantageous over other embodiments.

Figure 1:
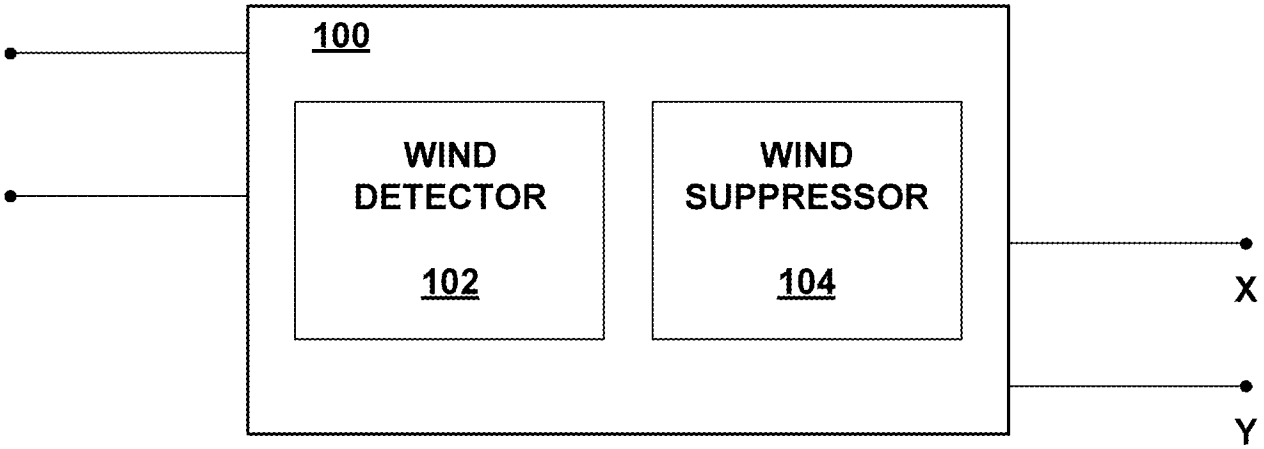
FIG. 1 is a block diagram of a pickup system in which signals from two input channels $CH_1$ and $CH_2$ are provided to a wind detector and a wind suppressor.

FIG. 1 is a block diagram of a pickup system 100 in which signals from two input channels $CH_1$ and $CH_2$ are provided to two processing components; wind detector 102, and wind suppressor 104. Two outputs of pickup system 100 are designated X and Y. While described in terms of a dual-channel system, by simple extension the principles presented herein are applicable to systems having a greater number of channels.

It should be apparent to those skilled in the art, that aspects of the algorithms used described herein are implementable using a form of frequency domain or filterbank analysis. In that regard, the signals generally referred to herein represent values obtained from the analysis of discrete time sampled microphone signal with a suitable transform. In one embodiment, the transform used is the well-known short time Fourier transform (STFT). Such a transform provides the ability to refer to the properties and describe the processing signal content at certain points of signal frequency, often referred to as bins, and larger ranges of frequency obtained by grouping or windowing, often referred to as bands. The specifics of the filterbank and banding strategy are not critical to the algorithms described herein, other than the requirement of sufficient temporal and frequency resolution to achieve the wind detection and suppression. For the general application of voice and audio capture, this is can be achieved by a filterbank such as the STFT having a frequency resolution of about 25-200 Hz and a time interval or resolution of about 5-40 ms. These ranges are indicative and instructive for reasonable performance and are not exclusive, as other ranges are contemplated. For simplicity and clarity, the figures represent the flow and processing of signal information. This is taken to represent signals corresponding to the relevant bins and bands according to the transform in a particular embodiment, and as required for the context and application of the described processing.

The sources of the input signals in channels $CH_1$ and $CH_2$ can be microphones (not shown), including but not limited to omni-directional microphones, uni-directional microphones and other types of microphones or pressure sensors or the like. Generally, wind detector 102 operates to detect the presence of corrupting wind influences in the channels $CH_1$ and $CH_2$, while wind suppressor 104 operates to suppress this influence. More specifically, wind detector 102 establishes a continuous estimate of wind, which it uses to graduate the activation of wind suppressor 104. Wind detector 102 uses an algorithmic combination of multiple features to increase the specificity of the detection and reduce the occurrence of "false alarms" that would otherwise be caused by transient bursts of sound common in voice and acoustic interferers as is common in prior art wind detection. This allows the action of the wind suppressor 104 to be primarily restricted to stimuli in which wind is present, thus preventing any degradation in speech quality due to unwarranted operation of wind suppression processing under normal operating conditions.

Figure 2A:
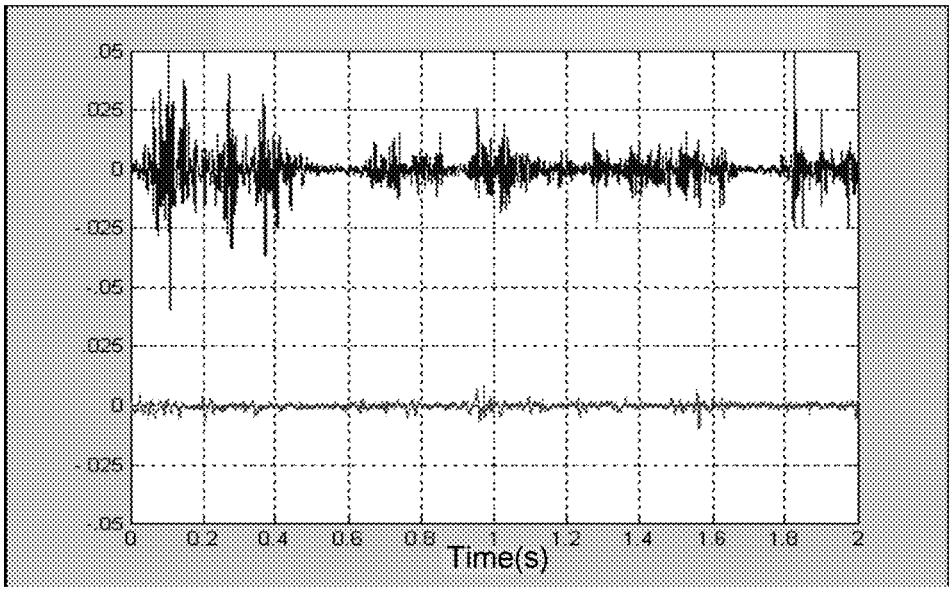
FIGS. 2A and 2B are plots of two sample periods of recordation of sound in the presence of wind in two channels.
Figure 2B:
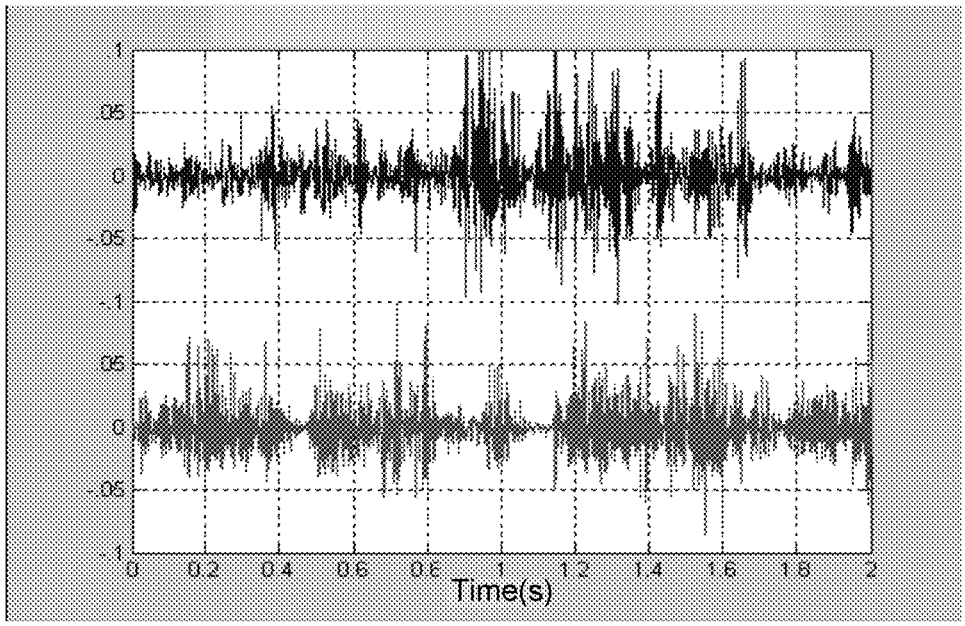

The general approach relied upon by wind detector 102 is a diversity-based attack. This approach relies on the ability of the transform or filterbank to segment the incoming signals over a suitable time and frequency window at which point the wind distortion becomes primarily an isolated disturbance on a particular channel. With reference to FIGS. 2A and 2B, it can be seen that for two sample periods of recordation of sound in the presence of wind in two channels, a low degree of correlation is exhibited between the channels. This effect is more pronounced when viewing the signal over both time and frequency windows. By reducing the contribution to the system output of the channel with a higher wind level in a given time-frequency window, the suppressor is able to selectively reduce the impact of wind. The effective wind speed in the FIG. 2B case is higher than that in the FIG. 2A case. The examples are obtained from an earpiece headset with around a 40 mm microphone spacing worn by a user with incident wind.

Figure 3A:
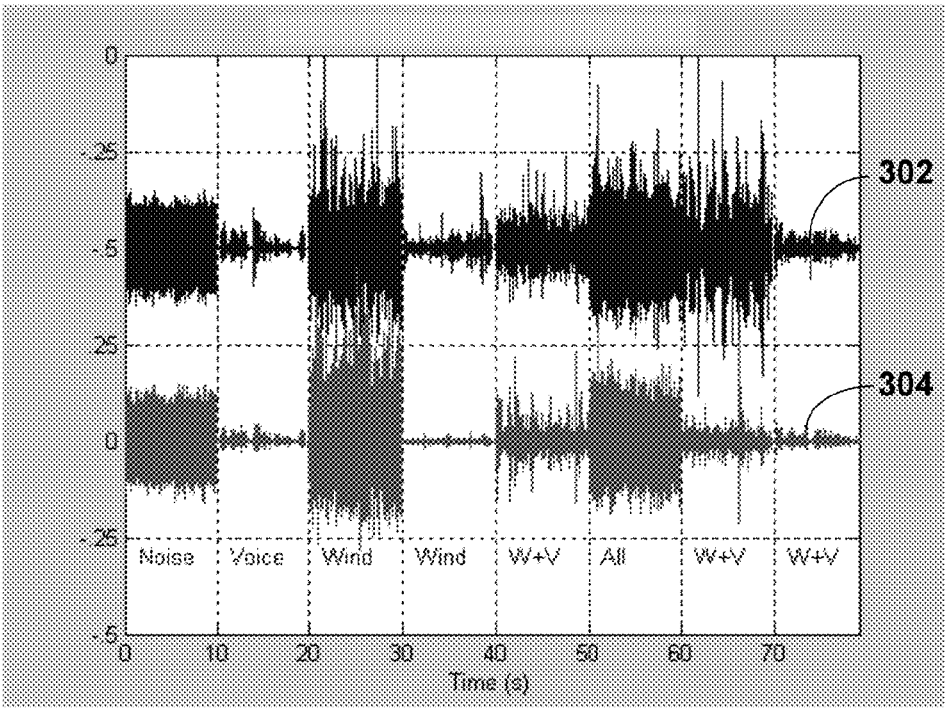
FIG. 3A is a compiled sample test sequence for two channels, labelled 302 and 304, in which signals indicative of noise, voice and wind, and combinations of these, are depicted.
Figure 3B:
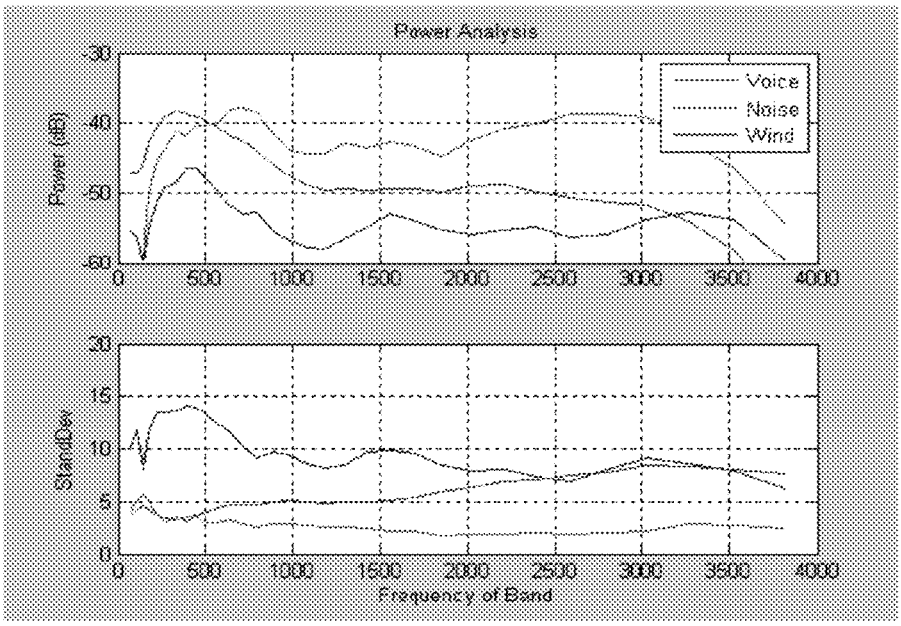
FIG. 3B is a plot of the average power spectra of the noise, voice and wind (306, 308, 310) and the variance of that power spectra over time (306*a*, 308*a*, 310*a*) from the sample test sequence.
Figure 3C:
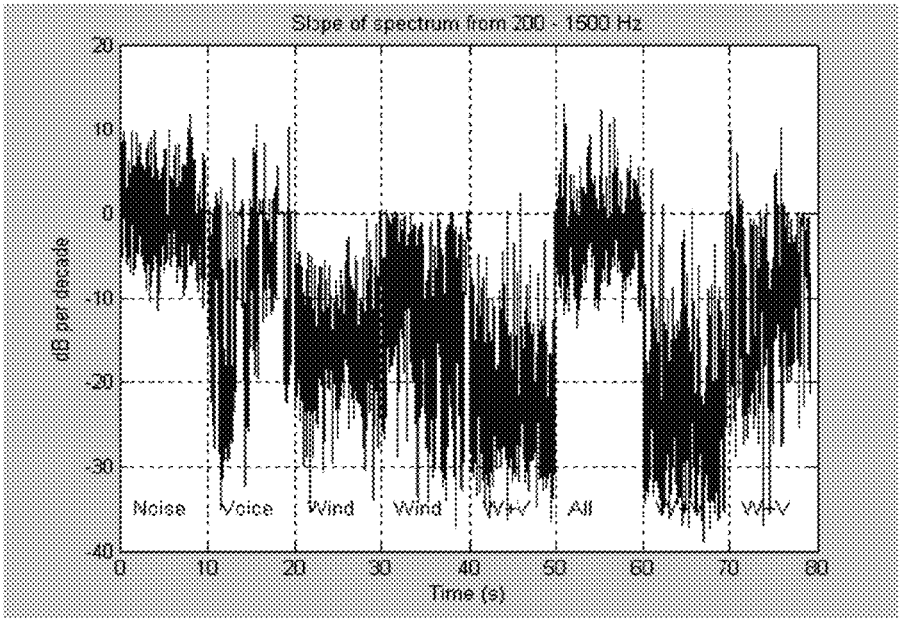
FIG. 3C plots the spectral slope feature, in decibels (dB) per decade, calculated from 200-1500 Hz, which are shown as would be inferred from the instantaneous power spectra.

Wind generally has a 'red' spectrum that is highly loaded at the low frequency end. FIG. 3A shows a compiled sample test sequence for two channels, labelled 302 and 304, in which signals indicative of noise, voice and wind, and combinations of these, are depicted. The average power spectra of the noise, voice and wind (306, 308, 310) and the variance of that power spectra over time (306*a*, 308*a*, 310*a*) from the sample test sequence are plotted in FIG. 3B. FIG. 3C plots the spectral slope feature, in decibels (dB) per decade, calculated from 200-1500 Hz, which are shown as would be inferred from the instantaneous power spectra. As seen in FIG. 3A, in this spectral range, the wind power spectra (310) has a significant downward trend when compared to the noise power spectra (306). Spectral slope is a measure of the change in energy with increasing frequency. FIG. 3C shows a plot of this spectral slope feature over time for the same stimulus. It can be seen that the spectral slope feature has an increasing negative value in the presence of wind, and is very good for segmenting wind and noise. However, this feature can also exhibit false alarms during speech as certain components of speech, such as strong formants and bilabel plosives also exhibit a strong negative slope in the spectra over the range of analysis.

Figure 3D:
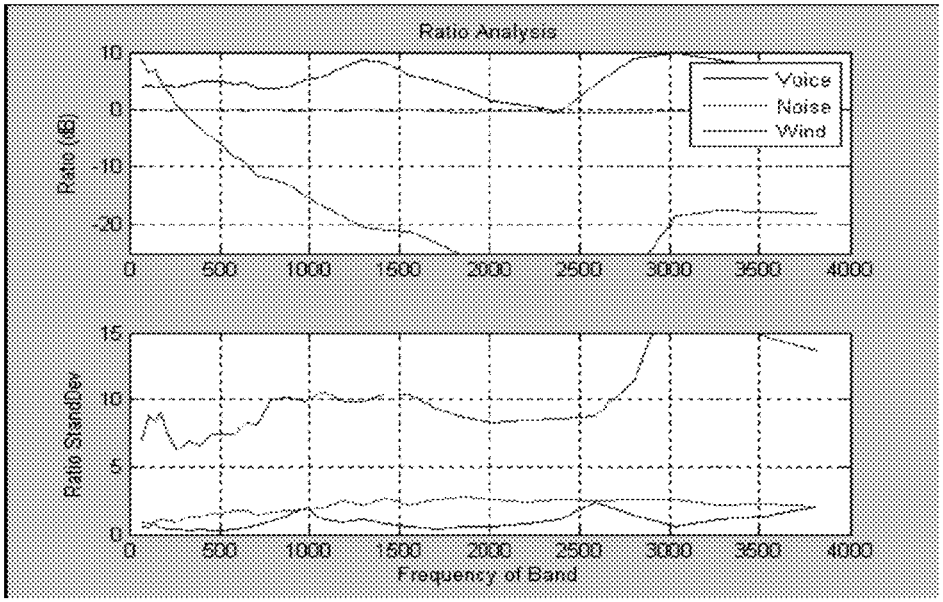
FIG. 3D is a plot showing the mean and standard deviation of the ratio (of for example power or magnitude) of the signals in the two channels.
Figure 3E:
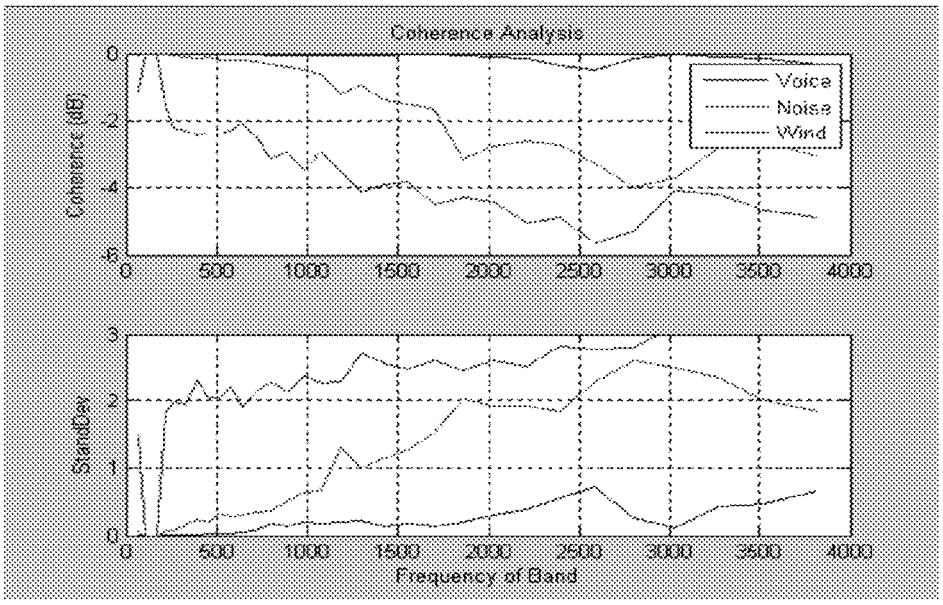
FIG. 3E is a plot showing the mean and standard deviation of the coherence, or signal consistency across multiple frequency or time bins, for the perceptual bands in training data for voice (312, 312*a*), noise (314, 314*a*) and wind (316, 316*a*)

Two other relevant characteristics or features that can be of used for distinguishing wind relate to its stochastic non-stationary nature. When viewed across time or frequency, wind introduces an extreme variance into spatial estimations. That is, the spatial parameters in any band become rather stochastic and independent across time and frequency. This is a result of wind having no structural spatial properties or temporal properties—provided there is some diversity of microphone placement or orientation, it typically approximates an independent random process at each microphone and thus will be uncorrelated over time, space and frequency. FIG. 3D shows the mean and standard deviation of the ratio (of for example power or magnitude) of the signals in the two channels, and FIG. 3E shows the mean and standard deviation of the coherence, or signal consistency across multiple frequency or time bins, for the perceptual bands in training data for voice (312, 312*a*), noise (314, 314*a*) and wind (316, 316*a*). A similar result is obtained when the standard deviation is taken across the frequency 'wind dominant' frequency bands ranging from 200 to 1500 Hz. By plotting the standard deviation of the ratio and coherence in these bands against time in FIGS. 3F and 3G for the constructed test stimulus, it can be seen that these standard deviations are a significant indicator of wind versus voice/noise. For both features, a larger standard deviation, or higher variance in the features across frequency indicates a greater likelihood of wind activity.

The illustrated ratio and coherence features are shown across the test vector for the variance calculated on a set of bands from 200 to 1500 Hz. Depending on the filterbank and banding approach, this may represent between 5 and 20 bands. These two features largely support each other; their key contribution comes from the ability to discriminate between voice and wind. This lowers the incidence of false alarms in wind detector 102 from voice activity. It is also interesting to note that these two ratio and phase features add sensitivity to wind when in a high noise environment. With high noise levels, the slope feature can be thwarted and does not detect wind bursts occurring amongst high noise. The ratio and coherence features add sensitivity in this case.

Other features that may be of interest are the absolute signal level, and the phase and phase variance. The phase and phase deviation or circular variance is shown in FIG. 3H. Such features can be used to offer further discriminatory power, but will increase the computational cost.

An approach to combining the features relating to slope, ratio standard and coherence standard in accordance with one embodiment is based on some tuned parameters which can be inferred from an analysis of the plots in FIGS. 3A through 3H. Generally, in one embodiment, a scaling of the individual features is performed so that excitation of 1 is an indication of wind, and 0 is the absence of wind in the signal. The three features, or parameters, that are used in one embodiment are set forth as follows, noting that the ranges selected are not exclusive to other similar possibilities:

Slope: the spectral slope in dB per decade using regression of the bands from 200 to 1500 Hz.

RatioStd: the standard deviation of the difference between instantaneous and expected ratios (in dB) in the bands from 200 to 1500 Hz.

CoherStd: the standard deviation of the coherence (in dB) in the bands from 200 to 1500 Hz.

It should be noted that coherence is mostly effective from 400 Hz or so, since the low bands may have low diversity (in terms of the number of bins that contribute to a band).

Figure 3F:
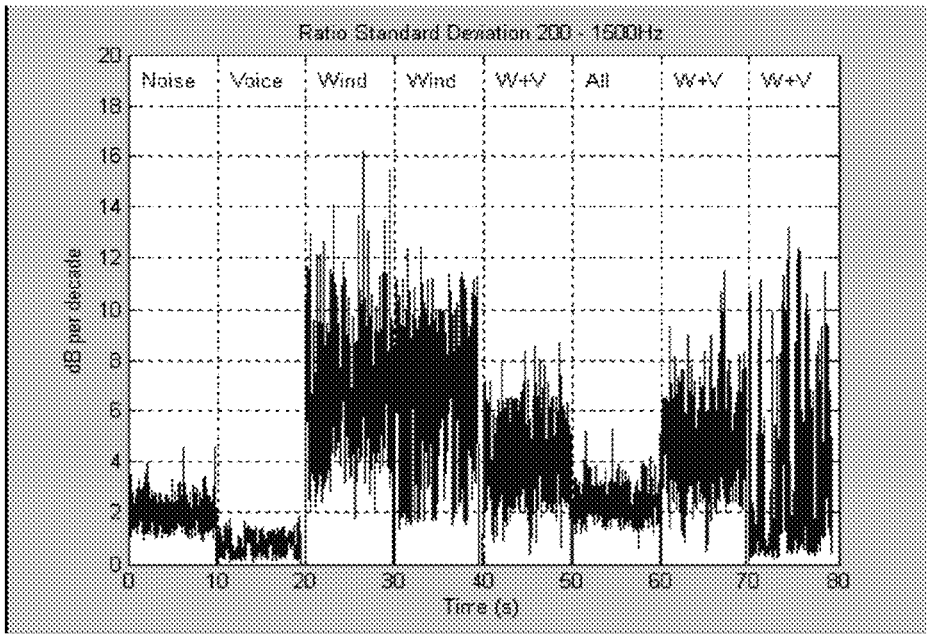
FIGS. 3F and 3G are plots showing the standard deviation of the ratio and coherence in these bands against time for the constructed test stimulus.
Figure 3G:
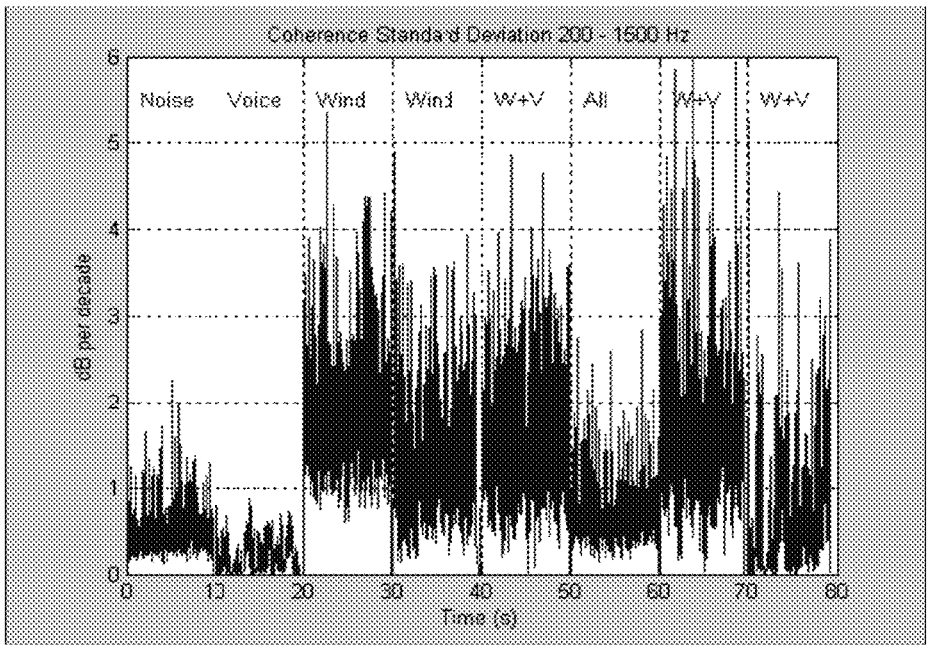
Figure 3H:
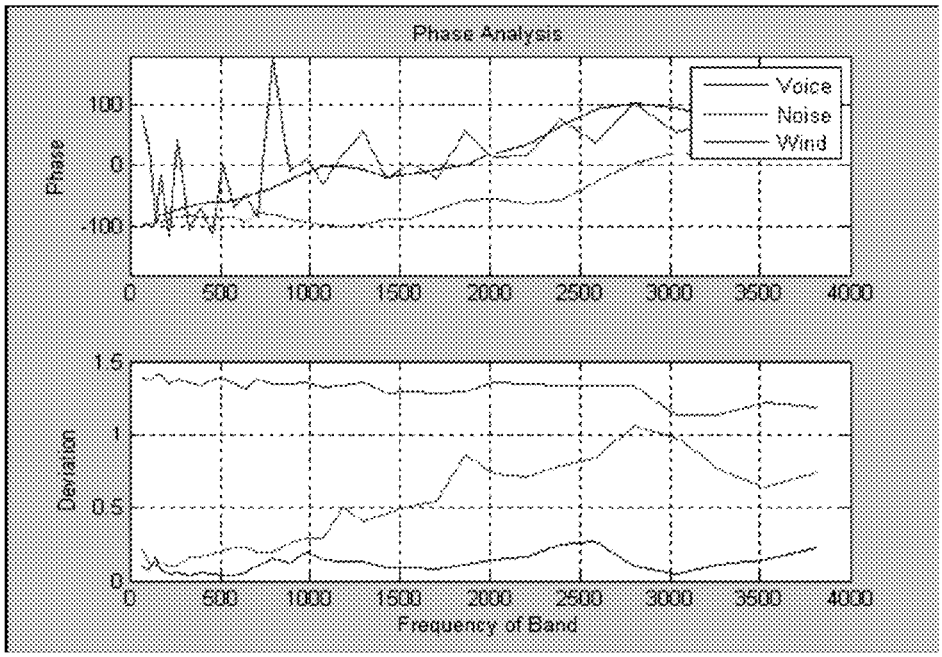
FIG. 3H is a plot of the phase and phase deviation or circular variance.

From the above features and corresponding graphs, the following partials are calculated with the scaling being suggestive but not exclusive to other similar values that would also be effective:

$$SlopeContribution = \max\left(0, \frac{\text{Slope} - WindSlopeBias}{WindSlope}\right) = \max\left(0, \frac{\text{Slope} - 5}{-20}\right) \quad (1)$$

$$RatioContribution = RatioStd / WindRatioStd = RatioStd / 4 \quad (2)$$

$$CoherContribution = CoherStd / WindCoherStd = CoherStd / 1 \quad (3)$$

wherein, in (1), Slope is the spectral slope, obtained from the current block of data, WindSlopeBias and WindSlope are constants empirically determined from the plots (FIG. 3C) in one embodiment, arriving at the values −5 and −20, to achieve a scaling of the SlopeContribution such that 0 corresponds to no wind, 1 represents a nominal wind, and values greater 1 indicating progressively higher wind activity, wherein, in (2), RatioStd is obtained from the current block of data and WindRatioStd is a constant empirically determined form FIG. 3F to achieve a scaling of RatioContribution with the values 0 and 1 representing the absence and nominal level of wind as above, and wherein, in (3), CoherStd is obtained from the current block of data and WindCoherStd is a constant empirically determined from FIG. 3G to achieve a scaling of CoherContribution with the values 0 and 1 representing the absence and nominal level of wind as above.

The overall wind level is then computed as the product of these and clamped to a sensible level, for example 2.

This overall wind level is a continuous variable with a value of 1 representing a reasonable sensitivity to wind activity. This sensitivity can be increased or decreased as required for different detection requirements to balance sensitivity and specificity as needed. A small offset (0.1 in this example) is subtracted to remove some residual excitation. Accordingly, WindLevel=min(2,max(SlopeContribution×RatioContribution×CoherContribution−0.1))

Figure 4:
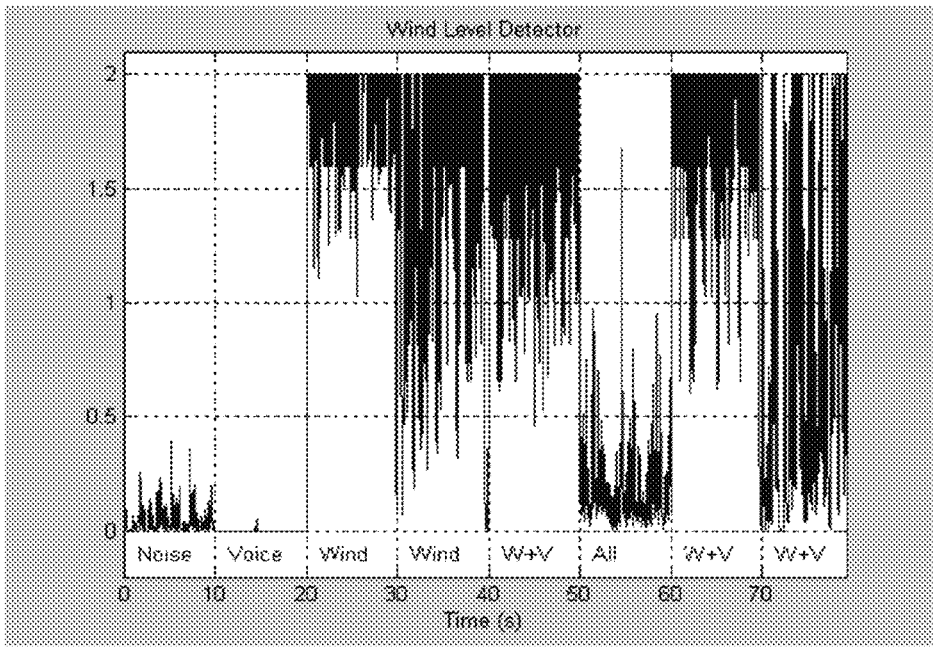
FIG. 4 is a plot of wind level with a 100 ms decay filter.

The signal can be further processed with smoothing or scaling to achieve the indicator of wind required for different functions. The WindLevel with a 100 ms decay filter is shown in FIG. 4.

It should be understood that the above combination, being predominantly multiplication, is in some form equivalent to the "ANDing" function in the form of:

WindLevel=SlopeContribution·RatioContribution·CoherContribution

Specifically, in one implementation, the presence of wind will be confirmed only if all three features indicate some level of wind activity. Such an implementation achieves a desired reduction in "false alarms", since for example whilst the Slope feature may register wind activity during some speech activity, the Ratio and Coherence features do not.

It should be noted that the above feature calculations are preceded by banding and correlation determinations as follows:

Given any transform into a frequency domain, the input frequency domain observations are $I_{1,n}$ and $I_{2,n}$ for n=0 . . . N−1. These are grouped together in a correlation matrix using some banding function (weighted combination of frequency bins).

$$R_b = \sum_{n=0}^{N-1} w_{b,n} [\, I_{1,n} \;\; \ldots \;\; I_{M,n} \,]^H [\, I_{1,n} \;\; \ldots \;\; I_{M,n} \,] = \begin{bmatrix} R_{b11} & R_{b12} \\ R_{b21} & R_{b22} \end{bmatrix}$$

The following features can then be obtained:

Power=$R_{b11}+R_{b22}$

Ratio=$R_{b22}/R_{b11}$ (used in the log domain for analysis)

Phase=angle($R_{b21}$)

$$\text{Coherence} = \left(\frac{R_{b12} R_{b21}}{R_{b11} R_{b22}}\right)^{1/2}$$

(can also be used in the log domain for analysis)

In one embodiment, a number of bands, typically between 5 and 20, covering the frequency range from approximately 200-1500 Hz are used. Slope is the linear relationship between 10 $\log_{10}$(Power) and $\log_{10}$ (BandFrequency). RatioStd is the standard deviation of the Ratio expressed in dB (10 $\log_{10}(R_{b22}/R_{b11})$) across this set of bands. CoherenceStd is the standard deviation of Coherence expressed in dB $$\left(10\log_{10}\left(\left(\frac{R_{b12} R_{b21}}{R_{b11} R_{b22}}\right)^{1/2}\right)\right)$$

across the set of bands.

It should be apparent that the use of base 10 logarithms is not essential, and that suitable scaling parameters could be determined for alternate log representations to simplify calculations.

Figure 5:
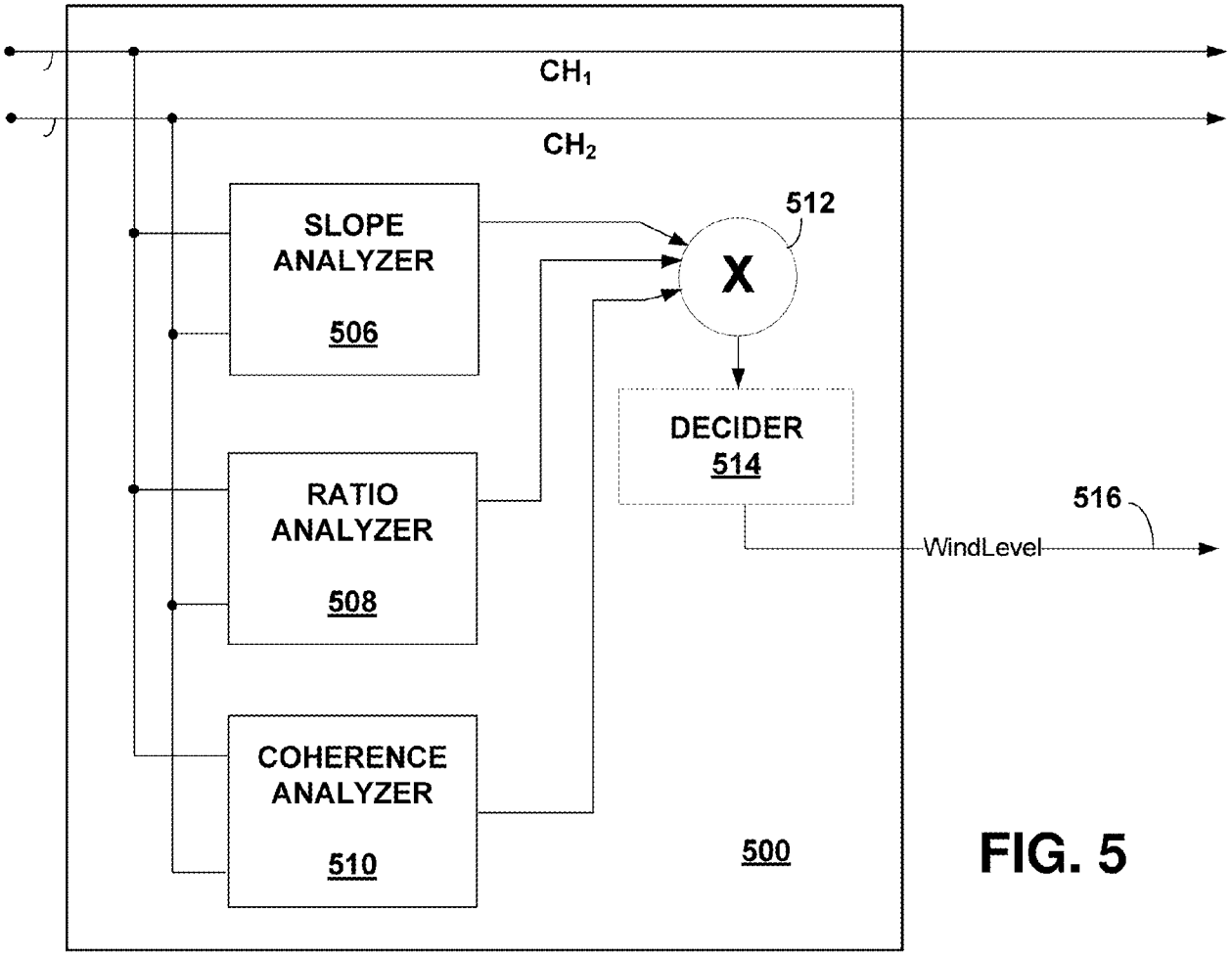
FIG. 5 is a block diagram showing details of a dual-channel wind detector in accordance with one embodiment.

FIG. 5 is a block diagram showing details of a dual-channel wind detector 500 in accordance with one embodiment. First and second inputs 502, 504 receive input signals from detectors such as microphones (not shown) and direct these input signals to a slope analyzer 506, a ratio variance analyzer 508, and a coherence variance analyzer 510. (It should be noted that while three analyzers are shown, more or less analyzers, each dedicated to a different feature of the signals in the two (or more) channels, can be used.) As detailed above, the outputs of the analyzers are scaled indications of the contributions of the slope, ratio and coherence. These indications are then provided to a combiner, in the general form of a multiplier 512. Scaling, offset and limiting as necessary are then performed in a wind level indicator 514 which then generates a WindLevel output signal 516. The output signal 516 can be continuous and provides an instantaneous indication of wind level. As explained above, WindLevel can range from 0 . . . 2 (or this could be any range in different embodiments). In one embodiment, the value of 0.0 is selected as a measure of very low wind probability or complete absence of wind, whilst a value of 1.0 is selected to indicate a reasonable likelihood of wind and larger values up to 2.0 indicate the presence of strong wind disturbance. As there are not defined units for wind activity, this value by design from the feature analysis will vary continuously with higher values indicating more wind disturbance. The absolute values and range of the wind level is important only to the extent it is used in a consistent manner throughout the remaining algorithm components. In one embodiment the continuous nature of the wind level output is relied upon to achieve continuous and gradual variation in the amount of suppression applied in the suppressor component. The continuous measure of wind avoids problems of discontinuity and distortion that would occur if the wind suppressor were to be always active, or discretely enabled, disabled or otherwise controlled. In other embodiments, the wind level indicator 514 decides whether the determined level from the combiner exceeds a triggering threshold, in which case a triggering signal is issued in output signal 516. Both the continuous and threshold decision regarding wind activity are useful signals for controlling the suppression and subsequent signal processing.

In one solution, the following signal model is implied for the input signals 502 and 504:

$$x_1=s+n_1$$

$$x_2=s+n_2$$

where $x_1$ and $x_2$ are the input signals containing the voice or desired sound component, s, equally but having different noise components $n_1$ and $n_2$. These signals are scaled and mixed together to create an intermediate signal (IS) as follows:

$$IS=\alpha x_1+\beta x_2=(\alpha+\beta)s+\alpha n_1+\beta n_2$$

$$\alpha+\beta=1$$

The intermediate signal IS is a linear combination of the two inputs with coefficients α and β. It can be seen that if the sum of coefficients α and β is constrained to unity $$\alpha+\beta=1$$

the intermediate signal will have a constant and undistorted representation of the desired signal s. The selection is then made to optimize in some way the intermediate signal. Such optimization can be based on minimizing the IS energy (thus maximizing the signal to noise ratio). Assuming the noises are uncorrelated, the optimum can be obtained in closed form. Based on this, continuous or discrete panning between the channels to select the least corrupted channel can be performed. The use of α as either 0, 0.5 or 1.0 can be made to switch away from a simple mix beamformer when the magnitude ratio of $x_1$ to $x_2$ is around 4.7 dB. This approach is applicable in the banded or fourier domain.

In the previous example, it is implicit that the intermediate signal, IS, is formed from a simple summation of the scaled input signals $\alpha x_1$ and $\beta x_2$. In a more general case, the nominal design of the of the intermediate signal IS may be by way of an arbitrary set of complex coefficients, $p_1$ and $p_2$. In one embodiment, these coefficients may create a beamformer with directionality approximating a hypercardiod. The hypercardiod is a good first approximation for minimizing the diffuse field pickup of a headset device since there is a null in the array sensitivity that is positioned approximately laterally away from the head. The passive mix down may also correct the equalization for the voice or desired signal that naturally occurs due to the spatial separation of the two microphone elements. Such an embodiment would realize a set of frequency dependent coefficients, $p_1$ and $p_2$, that implement a fixed group delay and varying magnitude response. In other embodiments the passive coefficients may be arbitrarily chosen to achieve desired sensitivity, directionality and signal properties in the nominal operation case defined in the absence of wind activity. The passive coefficients, $p_1$ and $p_2$, are specified for each band (and thus bin). The details and design of the passive array is not the subject of this invention, but rather the passive array, once designed or generated online, creates a signal constraint that is used to calculate the respective gains to be applied in the wind suppression component.

Also, in the general case, the voice or desired sound arriving at the microphone may have an arbitrary phase and magnitude relationship. Since it is narrow band signal representation that is of interest here, time delays can be replaced with complex coefficients. Since the incoming signal has an arbitrary and unknown scale at the microphone array, we define the signal model such that the voice or desired signal considered at the microphone signal $x_1$ has unity gain. The voice or desired signal at the other microphone then has a complex factor r which is frequency dependent. At a given frequency, we can define the expected ratio (in dB) for the voice or desired signal of the power in $x_2$ compared with $x_1$ as RatioTgt, and the expected relative phase (in radians) for the voice or desired signal of the signal $x_2$ compared with $x_1$, then the following identity applies:

$$r=10^{RatioTgt/10}e^{iPhaseTgt}$$

where $i=\sqrt{-1}$.

In normal operation arbitrary passive mix and arbitrary response of the array to the voice or desired signal has the following model $$x_1=s+n_1$$

$$x_2=rs+n_2$$

$$IS=p_1x_1+p_2x_2=(p_1+p_2r)s+p_{p1}n_1+p_2n_2$$

To achieve the wind suppression, a scaling factor is introduced to each channel, as the generalized and potentially complex panning coefficients α and β:

$$IS=\alpha p_1x_1+\beta p_2x_2=(\alpha p_1+\beta p_2r)s+\alpha p_1n_1+\beta p_2n_2$$

From this, a generalized constraint on the panning coefficients, α and β, can be derived:

$$(\alpha p_1 + \beta p_2 r) = (p_1 + p_2 r)$$

$$\alpha = 1 + \frac{p_2 r}{p_1}(1 - \beta)$$

$$\beta = 1 + \frac{p_1}{p_2 r}(1 - \alpha)$$

The final formulation shows each panning variable as a free variable calculated from the other. In this relationship the channel that is deemed to be wind-corrupted is identified and attenuated, while gain for the other channel is computed. The computed gain may be complex and increased or decreased in magnitude depending on the nature of the passive coefficients, $p_1$ and $p_2$, and the desired signal response factor r. This can be seen as a significant generalization and extension to achieve a panning constraint that will allow the attenuation of one channel and the correction of the other to reduce the distortion of the desired signal component obtained from an arbitrary passive mix, with an arbitrary array response for the desired signal location.

It is also apparent from the equations above that there may be singularity issues if $$\frac{p_2 r}{p_1} >> 1 \text{ or } \frac{p_2 r}{p_1} << 1,$$

in which case the dependent gain can become excessively large or small which can cause stability issues. For this reason panning is best restricted in some way by preventing either coefficient from becoming too small or too large.

If the ratio of power in $x_2$ to $x_1$ is Ratio dB, and the expected voice ratio is RatioTgt dB where using power ratios RatioTgt=20 $\log_{10}|r|$, and the expected noise or normal signal ratio is also close to 0 dB, one embodiment for calculating the attenuation of either channel can be implemented:

$$\alpha = 10^{Strength*WindLevel*(Ratio-RatioTgt)/20} \text{Ratio-Ratio-Tgt<0}$$

$$\beta = 10^{-Strength*WindLevel*(Ratio-RatioTgt)/20} \text{Ratio-Ratio-Tgt>0}$$

Where Strength is a parameter to control the overall aggressiveness of the wind suppression system with having suggested values in the range of 0.5 to 4.0, and WindLevel is signal (Windlevel) 516 from wind detector 500 (FIG. 5). In this embodiment, an attenuation parameter α or β is calculated for each frequency band at each time instant, based on the desired suppression strength, Strength, the globally estimated wind activity, WindLevel, the instantaneous signal ratio, Ratio, and the expected signal ratio for the desired signal, RatioTgt.

As discussed above, the attenuation of the selected channel can be restricted to retain some diversity in the output channels. A suggested limit to attenuation in one embodiment is from 10 to 20 dB. In this embodiment, if at any instant in a given band, WindLevel=0 then neither channel will be suppressed, and the selection and calculation of attenuation and correction coefficients can be avoided to reduce computational load. For the case where RatioTgt for the desired signal is substantially different to the normal expected diffuse field or noise response of the array, an offset or dead band can be introduced to reduce the distortion on the background noise or diffuse acoustic response that would otherwise occur during periods of wind activity signalled by WindLevel.

In each band, at a given instant, one channel is selected, and an attenuation parameter α or β is calculated. The alternate panning coefficient is calculated according to the constraint derived above. The derived panning coefficient may then be limited in magnitude range such that it is neither too large or too small, In one embodiment, such a suggested range is from −10 dB to +10 dB.

Figure 6:
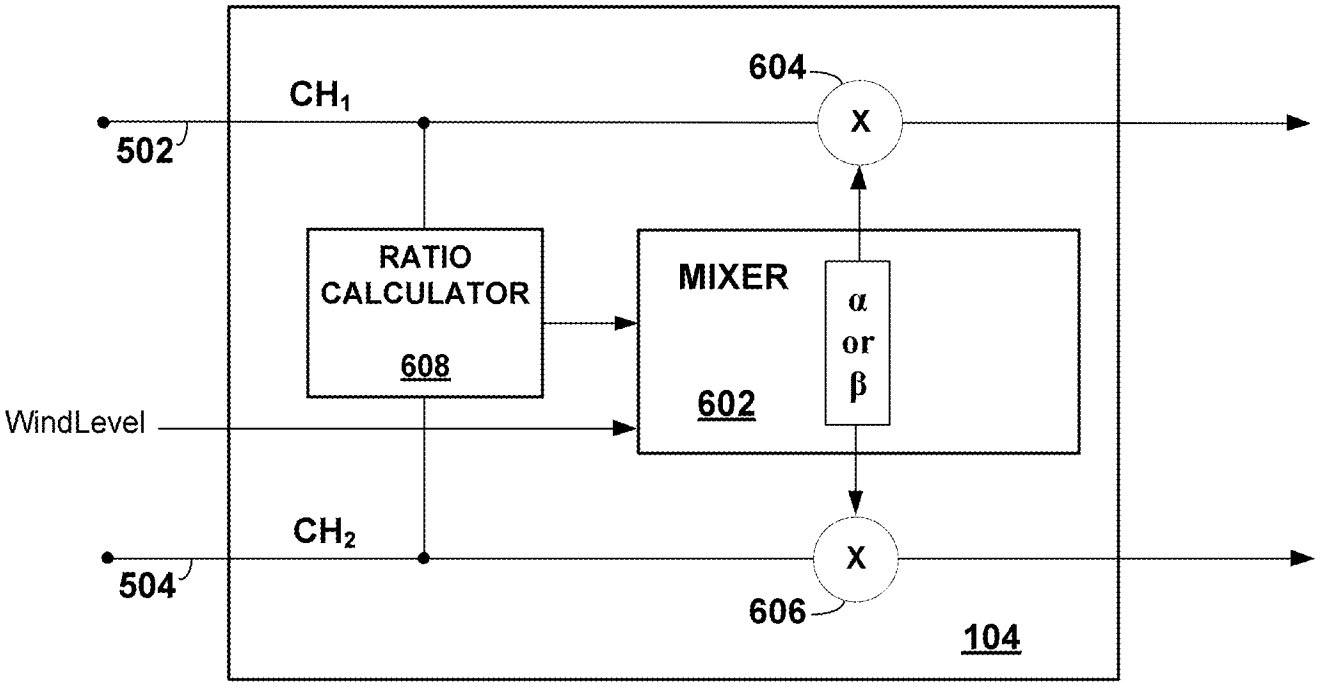
FIG. 6 is a block diagram of wind suppressor from FIG. 1.

FIG. 6 is a block diagram of wind suppressor 104 from FIG. 1. Wind suppressor 104 includes mixer 602 operative to apply attenuation and/or gain based on the panning factors α and β derived above. Operation of mixer 602 is a function of the output signal (Windlevel) 516 from wind detector 500 (FIG. 5). Gain and/or attenuation based on panning factors α and β are applied to the channels $CH_1$,$CH_2$ by way of multipliers 604, 606. The highest power channel, relative to the expected ratio for the desired signal, is selected to be attenuated based on the ratio, derived from ratio calculator 608. In one embodiment, the other channel can then be also modified by a gain calculated using a constraint equation as described above, and the attenuation gain for the first selected channel. (It should be noted that in one embodiment, ratio analyzer 508 operates over the limited range of from 200 to 1500 Hz, while ratio calculator operates over the full sound spectrum of interest).

If WindLevel=0, the attenuation would be unity (no attenuation). Essentially, for small values of WindLevel the wind suppressor 104 has no effect when. As WindLevel increases, and the instantaneous signal ratio, Ratio, is different from the expected ratio of the desired signal RatioTgt the attenuation is increased. At higher levels of WindLevel the suppression equations can become aggressive, acting to substantially discard the channel identified as having wind in a given band at a given time. If applied continuously, this would be a very severe and distorting approach to reducing wind, especially if trying to preserve some of the 'stereo diversity' of the original two channel signal. However, in suggested embodiments, the attenuation of a channel will only occur if there is an indication of wind in the overall signal from wind detector 500 (FIG. 5) and also an instantaneous departure in the ratio, Ratio, of a particular band at a particular time. The selective application of the attenuation in given bands, based on the global wind activity detection substantially reduces the extent over frequency and duration of any signal correction to achieve wind reduction. Furthermore, the corrective constraints described herein substantially reduce the distortion that would occur to the desired signal. Overall, the impact of the wind reduction system on the desired signal, and its use in any downstream processing, is significantly reduced. The selectivity of the suppression, due to the high specificity of the wind detection component ensures that any distortion is confined to activities of wind in the input signal, at which times there can often be a considerable amount of distortion present already. In this way, it is seen the presented embodiments can achieve substantial wind reduction with minimal impact on the signals in normal operation, and therefore an acceptable system wind reduction performance.

Some characteristics of the wind suppressor from one embodiment are:

one channel is selected to be attenuated the channel is selected based on instantaneous compared to desired ratio RatioTgt the attenuation is dependent on the deviation from the expected ratio (Ratio−RatioTgt)

the attenuation is continuously dependent on the WindLevel obtained from the detector at WindLevel=0 the attenuation is minimal (or absent)

as increases the attenuation becomes more severe a limit to the attenuation may be used to retain some stereo diversity In one embodiment, the previous expressions for the selected attenuated channel in the suppressor, α or β, can be described by more general functions $f_\alpha$, $f_\beta$ is characterized as follows:

with a range of (0 . . . 1]

$$\text{Unit for no wind activity } f_\alpha(0, \text{Ratio}, RatioTgt) = 1$$

$$\text{Unity if Ratio} = RatioTgt \quad f_\alpha(WindLevel, RatioTgt, RatioTgt) = 1$$

$$\text{Monotonic with } WindLevel \quad \frac{\partial f_\alpha(WindLevel, \text{Ratio}, RatioTgt)}{\partial WindLevel} \leq 0$$

$$\text{Monotonic with Ratio} \quad \frac{\partial f_\alpha(WindLevel, \text{Ratio}, RatioTgt)}{\partial \text{Ratio}} \geq 0$$

$f_\beta$(WindLevel, Ratio, RatioTgt) has range of (0 . . . 1]

$$\text{Unit for no wind activity } f_\beta(0, \text{Ratio}, RatioTgt) = 1$$

$$\text{Unity if Ratio} = RatioTgt \quad f_\beta(WindLevel, RatioTgt, RatioTgt) = 1$$

$$\text{Monotonic with } WindLevel \quad \frac{\partial f_\beta(WindLevel, \text{Ratio}, RatioTgt)}{\partial WindLevel} \leq 0$$

$$\text{Monotonic with Ratio} \quad \frac{\partial f_\beta(WindLevel, \text{Ratio}, RatioTgt)}{\partial \text{Ratio}} \leq 0$$

In this embodiment, the suppression functions are structurally similar with the main difference being the sign of the monotonic variation with Ratio.

One embodiment described herein fits these general requirements with Ratio and RatioTgt expressed in the log domain.

Further, as explained above, in one embodiment, one channel is attenuated, and a gain (potentially complex) is applied to the other channel for correction. In this manner, the output of a subsequent passive array (not shown) maintains the signal level of the desired target. The gain applied to the other channel may be complex and have magnitude greater than or less than unity. It can be seen that if $p_1=p_2=0.5$ and r=1 then α+β=2 and simple panning occurs between the two channels. If at a particular instance, the first channel is selected for attenuation, α=0.5, then it would follow that the other channel would increase in gain to correct, β=1.5. By contrast, as described herein, more general cases are considered, for example if in the present embodiment, the associated passive array was $p_1=0.5$ and $p_2=-0.5$ with r=2 then the constraint for this example would be −α+2β=1. If in this case the first channel was attenuated, α=0.5, the correction to the other channel would be β=0.75 effecting an attenuation of the second channel also. Without any loss of generality, this example is provided to show that the constraint and associated correction is dependent on the intended passive array and desired signal properties, and can result in a gain or attenuation, or arbitrary complex scaling of the other channel in order to achieve the desired correction. The correction is defined such that the transmission function or power of the desired signal (s) that would result after a defined passive mixdown operation is preserved.

Figure 7:
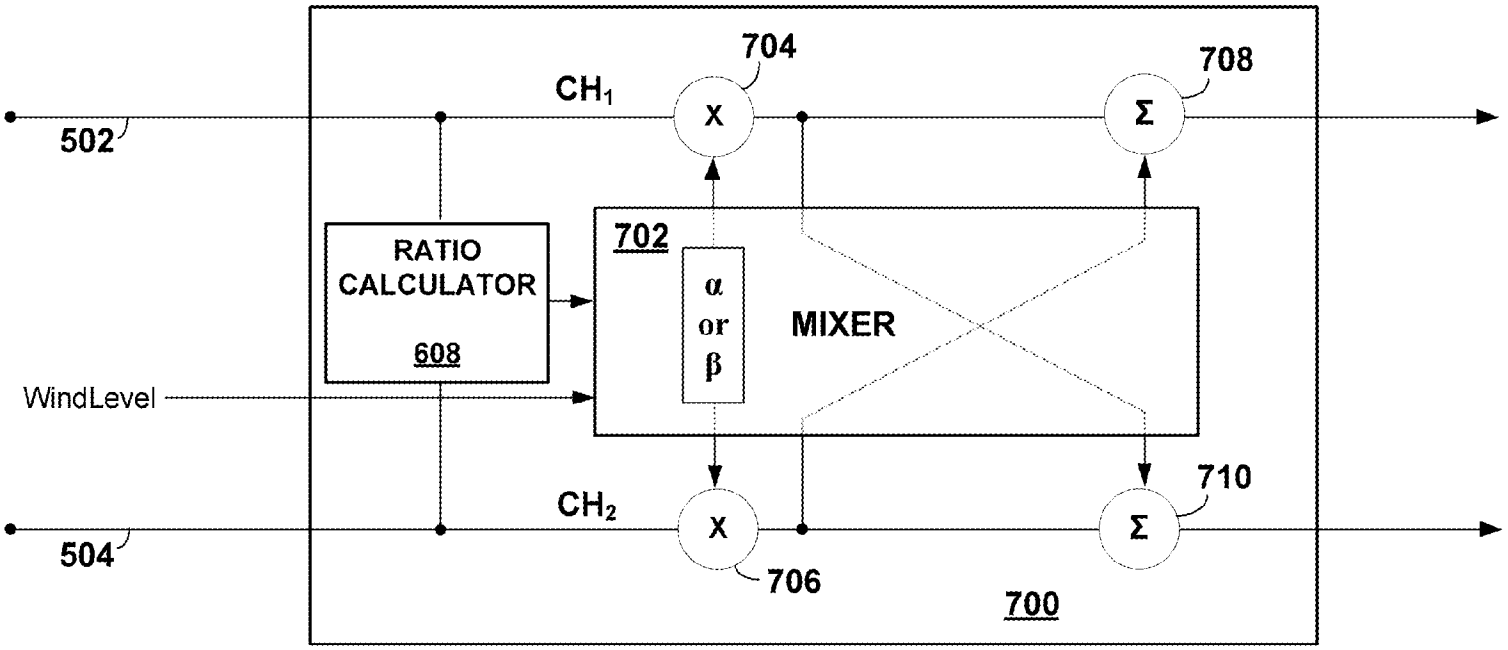
FIG. 7 is a block diagram of a wind suppressor in accordance with one embodiment.

FIG. 7 is a block diagram of a wind suppressor 700 in accordance with one embodiment. In this arrangement, after attenuating one channel $CH_1$ or $CH_2$ at multipliers 704 or 706, mixer 702 leaves the other channel unchanged. Mixer 702 then mixes or copies a portion of the unchanged channel into the attenuated channel, by way of combiners 708, 710, again to preserve the level of the target signal that would be output from some subsequent array. As in the above arrangement, Mixer 702 uses the Windlevel signal and a ratio signal from ratio calculator 702 to determine the attenuation/gain factors α and β applied.

Extending the signal model from before, we construct two channels using an arbitrary combination of scaling and mixing $$x_1=s+n_1$$

$$x_2=rs+n_2$$

$$x'_1=\alpha x_1+\gamma x_2$$

$$x'_2=\beta x_2+\delta x_1$$

$$IS=p_1x'_1+p_2x'_2=(\alpha p_1+r\gamma p_1+r\beta p_2+\delta p_2)s+\alpha p_1n_1+\delta p_2n_1+\beta p_2n_2+\gamma p_1n_2$$

and again consider the constraint such that the desired signal has constant transmission to the intermediate signal, IS, $$(\alpha p_1+r\gamma p_1+r\beta p_2+\delta p_2)=(p_1+p_2r)$$

If one channel is selected for attenuation, and the other channel is to remain unchanged, two constraints can be derived from this to specify the gain to use in mixing the unchanged channel into the attenuated channel $$\gamma = \frac{1}{r}(1-\alpha)$$

$$\alpha < 1, \beta = 1, \delta = 0$$

$$\delta = r(1-\beta)$$

$$\beta < 1, \alpha = 1, \gamma = 0$$

Since this mixing restores the correct amount of the desired signal into the otherwise attenuated channel, this approach does not depend explicitly on the downstream passive mix. It should be apparent to some-one skilled in the art, that the preceding equations define a constraint across four variables α, β, γ, δ that can achieve and arbitrary scaling and mixing of the signal pair. In one embodiment, one channel is selected for attenuation and a combination of mixing back and scaling of the other channel is used to achieve the desired constraint. In this embodiment, the relationship between the amount to be mixed across, and the alternate channel gain correction are given as $$\gamma = \frac{1}{r}(1-\alpha) + \frac{p_2}{p_1}(1-\beta)$$

$$\beta = 1 + \frac{p_1}{p_2 r}(1-\alpha-r\gamma)$$

$$\alpha < 1, \delta = 0$$

$$\delta = r(1-\beta) + \frac{p_1}{p_2}(1-\alpha)$$

$$\alpha = 1 + \frac{p_2 r}{p_1}\left(1-\beta-\frac{1}{r}\delta\right)$$

$$\beta < 1, \gamma = 0$$

It can be seen that this creates a set of solutions which is consistent with and further generalizes the previously presented constraint equations.

The approaches of FIGS. 6 and 7 are similar in construct. The benefit of the FIG. 7 approach is that the two channels remain more 'balanced' whereas in the FIG. 6 case, one channel may be completely attenuated. In the case of FIG. 7 subsequent downstream processing (such as an upmixer) can be decoupled from the wind suppression as the preserved signal content and desired signal is spread across the two channels. In cases of extreme attenuation of one channel, the correction approach set out in FIG. 7 will act to largely duplicate one channel into both outputs, whereas the approach set out in FIG. 6 and described above will act largely to fully attenuate one channel whilst correcting the other. In both systems, the overall signal diversity is the same, and both systems would maintain the effective output level of the desired signal after a subsequent passive mix. As such, it should be apparent that there are a multitude of systems possible by combining the two methods.

Based on the above, a solution for determining to which channel, and how much attenuation, is to be applied to reduce the corruptive influence of wind is provided. The solution involves for example fading out one channel in wind, and combining the wind detector 102 and the voice preserving panning equations, mixing technique or the more generalized constraint formulation. The wind detector 102 is operable to provide, at 516 (FIG. 5), a wind level indication (WindLevel), which may be in the form of an output signal having a continuous range of values related to the level of wind activity determined in channels $CH_1$ and/or $CH_2$ in a monotonic fashion. Wind suppressor 104 (602, 702) then uses this continuous level to adjust the extent of processing.

Figure 8A:
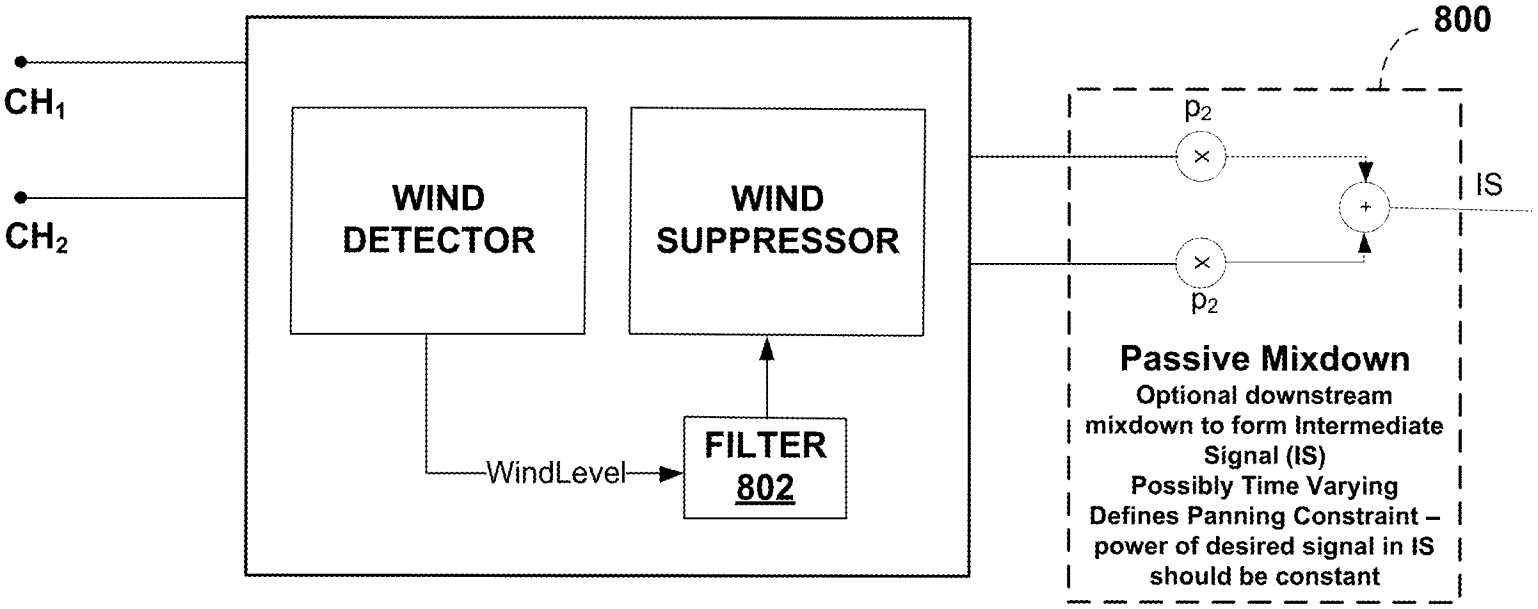
FIG. 8A is a block diagram including a mix down arrangement in accordance with one embodiment.

It is noted that in some embodiments generally the same suppression equations introduced above apply for the FIG. 6 and FIG. 7 arrangements. The suppression functions are seen to attenuate a specified channel if there is wind activity indicated by WindLevel and the instantaneous ratio in that band indicates the particular channel has excess power compared with the desired signal expected ratio, RatioTgt. With the selected channel attenuated, the system then applies a 'correction' to satisfy a constraint. The constraint is defined to maintain the power or signal level of the desired signal that would result at the output of a defined passive mixdown, specified by the parameters $p_1$ and $p_2$. The passive mix down may or may not occur as it is used to define a constraint, and not a necessary part of this system. In this regard the embodiments described create a wind suppression system with multiple inputs and outputs. The mix down arrangement is shown in FIG. 8, and designated 800.

In the arrangement of FIG. 6, the correction is achieved by also scaling the other channel. Thus the second channel gain becomes a dependent parameter on the first. This provides the two equations above deriving $\alpha$ and $\beta$ and vice versa. The scaling may be complex and may boost or attenuate the other channel. The constraint equation depends on the ratio and phase of the desired signal, r, and the intended passive coefficients, $p_1$ and $p_2$.

In the arrangement of FIG. 7, the same constraint is achieved with a correction that mixes signal from the unattenuated channel back into the attenuated channel. Whilst this method achieves a similar goal (to preserve the energy of the target signal s output from a passive mix down), it does not depend explicitly on the passive mixdown itself. This provides the two equations above deriving $\gamma$ from $\alpha$, and $\delta$ from $\beta$. In the case of using mixing only, the constraint does not depend on the coefficients of the intended passive mix.

In the general case, the constraint may be achieved by a combination of mixing into the attenuated channel, and a corrective gain applied to the other channel. In this case, the constraint is again dependent on the desired signal, r, and the intended passive coefficients, $p_1$ and $p_2$. All of the suggested approaches achieve the same goal, being preservation of the desired signal level after the defined passive mix down if it were to occur in subsequent signal processing.

In the case of r=1, and the mix equations of FIG. 7 the approach becomes that of fading from two independent channels, to one duplicated channel as the WindLevel increases and the ratio between the two channels deviates from the normal expected ratio (which is 0 dB or unity when r=1). This provides for a gradual migration of a stereo, or multichannel audio signal, to one of lower diversity as the wind level increases and the signal is corrupted on individual frequency bands. Due to the intermittent nature of wind, and typical disjoint activity over frequency and time, this approach preserves a stereo signal over much of the signal bandwidth well into significant wind. The selective overall wind detector creating the WindLevel signal, and the use of instantaneous ratio in frequency bands allows for preservation of the signal not corrupted by wind. Furthermore, the constraints for correction, as set out above, ensure that the timbre and spatial location of the audio signal at the array, corresponding to a source from the desired signal or target direction, will remain relatively stationary in loudness, timbre and relative ratio and phase between the output channels.

In this way, FIG. 7 and related embodiments present a 'two channel' wind suppression algorithm that retains the signal balance in the two channels, but may reduce to a 'mono' or duplicated single channel signal in any time-frequency band where one channel is dominated by wind. The attenuation and mixing constraint aims to preserve the correct amount of target signal in each channel. In contrast, FIG. 6 also presents a 'two channel' wind suppression algorithm that retains the signal separation between the two channels, but may reduce to a 'single channel' signal with only one channel having significant energy in any time-frequency band where one channel is dominated by wind.

Referring again to FIG. 8A, it can be seen that that a filter 802 may be used to filter the WindLevel signal issuing from the wind detector to the wind suppressor. The wind features analysis (506 508 120) and decider (514) provide an instantaneous measure of the wind activity in each frame. Due to the nature of wind and aspects of the detection algorithm, this value can vary rapidly. The filter is provided to create a signal more suitable for the control of the suppression signal processing, and also to provide a certain robustness by adding some hysteresis that captures the rapid onset of wind, but maintains a memory of wind activity for a small time after the initial detection. In one embodiment this is achieved with a filter having low attack time constant, so that peaks in the detected level are quickly passed through, and a release time constant of the order of 100 ms. In one embodiment, this can be achieved with simple filtering as

```
FilteredWindLevel=WindLevel

if

WindLevel>WindDecay×
    FilteredWindLevel=WindDecay×Filtered-
    WindLevel
```

otherwise where WindDecay reflects a first order time constant such that if the WindLevel were to be calculated at an interval of T, WindDecay~exp (−T/0.100), resulting in a time constant of 100 ms.

Figure 8B:
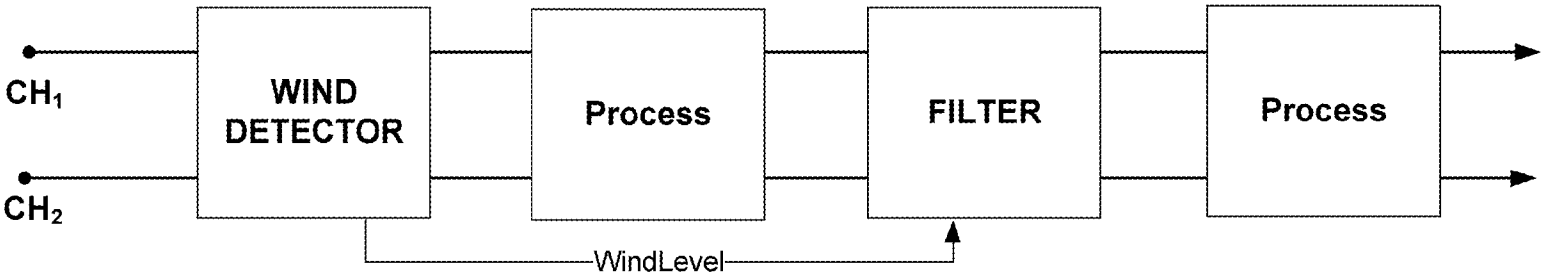
FIG. 8B is a block diagram showing the use of the wind detector for controlling parameters of a filter.

In addition to controlling the operation of wind suppressor 104, wind detector 102 can be used to control other types of processing, such as that of a high pass or shelf filter as seen in FIG. 8B, wherein the WindLevel output of the wind detector is provided to the filter intermediate to other processes in the processing chain. Control of filter parameters such as cutoff or attenuation is contemplated. Thus a parameterized high pass filter can be faded in based on wind activity using a version of the continuous wind detector. This can be done at the band level, modifying the cutoff frequency and or filter depth in a continuous manner as a function of the estimated wind level. Such an approach can use the same filterbank as the analysis and does not incur any real processing cost, since it is simply an additional factor in the resultant banded gains.

It should be apparent that this can be extended beyond two microphones or channels. For two channels or microphones there is a one dimensional panning surface available that preserves the voice. For 3 microphones this would be a 2 dimensional surface, but can similarly be computed, traversed, searched and optimized to reduce wind. The embodiments described herein can be generalized to N microphones and M output signals with P source locations required to be preserved. In the present case, M=1 and P=1, for a single intermediate signal and one target voice position. Provided M+P<N then a panning contour of N−M−P+1 dimensions can be created that will preserve the output statistics of the M output signals that would result from the excitation of P sources at fixed positions. Depending on the severity and consistency of the wind, then the subspace can be searched for some optimal position to reduce the corruption of the outputs. It follows that simple discrete microphone interference can be tolerated on N−M−P+1 microphones or sensors with complete restoration of the P sources in M signals possible. In contrast to the classical prior art, that poses this problem as an optimization assuming an arbitrary multidimensional interference across the N microphones, the approach and embodiments set out in this invention provide a method of direct inspection and decision to attenuate specific individual microphones. This is well suited to the wind disturbance which is typically discretely present and independent across time, space and frequency. The key aspects of the present invention that can be extended to larger number of microphones in this way are; the use of a multi feature continuous wind detector to control gradual activation of the suppression, the approach of selecting and attenuating specific microphones and the use of a panning constraint or remixing operation to correct the array output signals. As described in the embodiments, this approach is computationally efficient, effective for wind reduction and avoids unwanted distortion and filtering from the suppression component in the absence of wind activity.

The generalized constraint for the multi dimensional case can be conveniently expressed and calculated using the array correlation matrix. This contains all the information necessary for the calculations. For two channels, it can be seen that the ratio, phase and coherence contain complete information of the correlation matrix. For more than two microphones, the constraint is more elegantly expressed as a using signal vectors and correlation matrices. If the correlation matrix for the desired sources of interest S (N×N) is known, and the nominal passive mix down matrix W (M×N) is available, then these can be used to define an equivalence class of invariant transforms such that the output correlation matrix (M×M) is not effected by the panning or mixing transform. Briefly this is posed as solving for the panning and mixing space V (N×N) such that WVSV'W'=WSW', which can be decomposed as a simple diagonal problem on the eigenspace of S. S is expected to be rank deficient (generally it will be rank P); otherwise the solution is singular (V=I). The panning and mixing matrix V will be constrained to attenuate or lower the contribution from specific microphone channels based on the wind level signal and the identification and selection of channels likely to be corrupted at that instant by wind.

Figure 9:
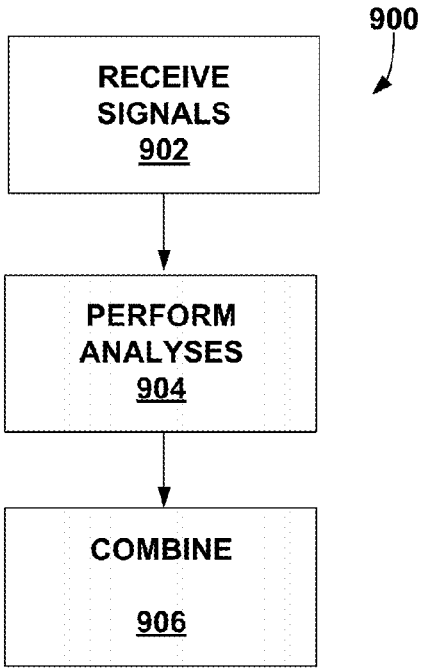
FIG. 9 is a flow diagram illustrating a wind detection 900 method in accordance with one embodiment.

FIG. 9 is a flow diagram illustrating a wind detection 900 method in accordance with one embodiment. At 902, first and second input signals are received. At 904, a plurality of analyses are performed on the first and second input signals. The plurality of analyses are selected for example from spectral slope analysis, ratio analysis, coherence analysis and phase variance analysis. At 906, results of the plurality of analyses are combined to generate a wind level indication signal.

Figure 10:
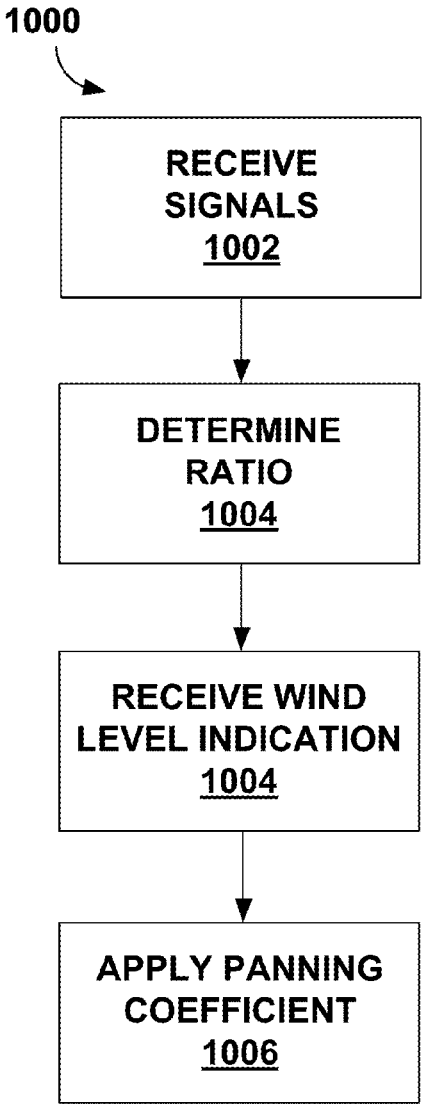
FIG. 10 is a flow diagram of a wind suppression method 1000 in accordance with one embodiment.

FIG. 10 is a flow diagram of a wind suppression method 1000 in accordance with one embodiment. At 1002, first and second input signals are received. At 1004, a ratio of the first and second input signals is determined. At 1006, a wind level indication signal is received, and at 1008, one of the first or second input signals is selected to apply thereto one of first or second panning coefficients based on the wind level indication signal and on the ratio, the other of the first or second input signals being unselected.

Figure 11:
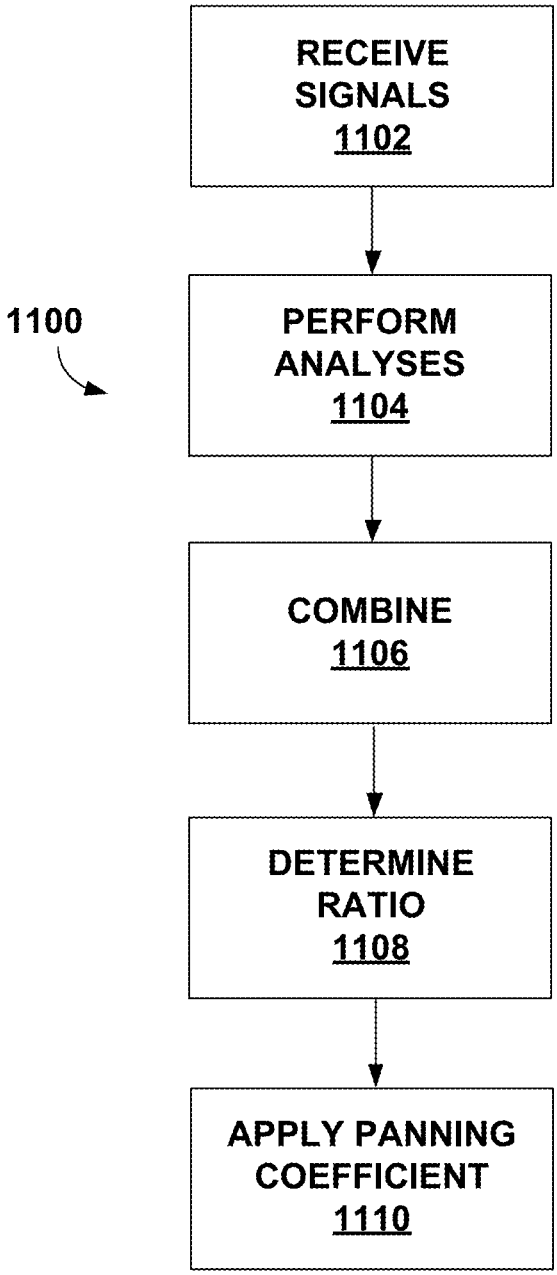
FIG. 11 is a flow diagram of a wind detection and suppression method 1100 in accordance with one embodiment.

FIG. 11 is a flow diagram of a wind detection and suppression method 1100 in accordance with one embodiment. At 1102, first and second input signals are received. At 1104, a plurality of analyses are performed on the first and second input signals, the plurality of analyses being selected from spectral slope analysis, ratio analysis, coherence analysis and phase variance analysis. At 1106, results of the plurality of analysis are combined to generate a wind level indication signal. At 1108, a ratio of the first and second input signals is determined. At 1110, one of the first or second input signals is selected to apply thereto one of first or second panning coefficients based on the wind level indication signal and on the ratio, the other of the first or second input signals being unselected.

While embodiments and applications have been shown and described, it would be apparent to those skilled in the art having the benefit of this disclosure that many more modifications than mentioned above are possible without departing from the inventive concepts disclosed herein. The invention, therefore, is not to be restricted except in the spirit of the appended claims.

What is claimed is:

1. A wind detector configured to receive a pair of input signals comprising a first channel and a second channel, the wind detector including:

a plurality of analyzers each configured to analyze the pair of input signals; and a combiner configured to combine outputs of the plurality of analyzers and issue, based on the combined outputs, a wind level indication signal indicative of wind activity; and a wind suppressor including:

a ratio calculator configured to generate a ratio of subband powers of the pair of input signals; and an attenuator configured select one of the pair of input signals and attenuate a selected channel one of the first channel and second channel and apply a gain factor to the other of the first channel and second channel to correct for the attenuation of the selected channel, wherein the attenuation is a function of a wind detector output signal provided to the wind suppressor, a current ratio of the sub-band powers for the first and second input signals, and a pre-selected ratio value for the sub-band powers of the first and second input signals.

2. The wind detector of claim 1 wherein the attenuation is continuously dependent on the wind level indication signal, and wherein a zero wind level indication signal yields no attenuation.

3. The wind detector of claim 2 wherein the attenuation is limited to a maximum defined value to maintain a minimum level of stereo diversity between the first and second channels.

4. The wind detector of claim 1 further comprising a mixer configured to select one of the first and second input signals and to apply to said selected input signal one of first or second panning coefficients based on the wind level indication signal and on the ratio, the one or more others of the plurality of input signals being unselected, and wherein application of the first or second panning coefficients is a function of a ratio of the first and second input signals.

5. The wind detector of claim 4, wherein the first and second panning coefficients are related as $$\alpha = 1 + \frac{p_2 r}{p_2}(1 - \beta)$$

$$\beta = 1 + \frac{p_1}{p_2 r}(1 - \alpha)$$

where α is one of the first or second panning coefficients, β is the other of the first or second panning coefficients, p1 and p2 define a passive array characterizing anticipated processing subsequent to wind suppression, and r is a complex factor defining sub-band relationships between first and second input signal sub-bands for a desired signal.

6. The wind detector of claim 5, wherein the plurality of input signals are first and second input signals, and wherein r is defined as:

$$r = 10^{-RatioTgt/10} e^{-iPhaseTgt}$$

where RatioTgt is a pre-selected sub-band ratio (in dB) value of the first and second input signals, and PhaseTgt is a pre-selected phase difference value between first and second input sub-band signals.

* * * * *